US005308196A

United States Patent [19]

Frederick

[11] Patent Number: 5,308,196

[45] Date of Patent: May 3, 1994

[54] YIELDABLE CONFINED CORE MINE ROOF SUPPORT

[75] Inventor: John R. Frederick, Aurora, Utah

[73] Assignee: The Coastal Corporation, Houston, Tex.

[21] Appl. No.: 35,722

[22] Filed: Mar. 23, 1993

[51] Int. Cl.[5] ..... E21D 11/00

[52] U.S. Cl. ..... 405/288; 248/354.2; 405/289; 405/303

[58] Field of Search ..... 405/288, 289, 290, 303; 248/354.2

[56] References Cited

U.S. PATENT DOCUMENTS

| | | | |
|---|---|---|---|
| 31,777 | 3/1861 | Boynton . | |
| 83,663 | 9/1868 | Walters . | |
| 87,016 | 2/1869 | Walters . | |
| 456,646 | 7/1891 | Clark . | |
| 614,729 | 11/1898 | Lally . | |
| 881,609 | 3/1908 | Nellen et al. | 248/354.2 |
| 987,397 | 3/1911 | Pittroff . | |
| 1,895,053 | 1/1933 | Staley | 248/354.2 |
| 2,510,688 | 6/1950 | Evans et al. | 248/354.2 |
| 3,188,041 | 6/1965 | Town | 248/365 |
| 3,196,061 | 7/1965 | Paulson | 156/63 |
| 4,277,204 | 7/1981 | Koppers et al. | 405/288 |
| 4,497,597 | 2/1985 | Chlumecky | 405/288 |
| 4,712,947 | 12/1987 | Thom | 405/288 |
| 4,726,714 | 2/1988 | MacArthur | 248/354.2 X |
| 5,143,340 | 9/1992 | Wood et al. | 249/354.2 |
| 5,143,484 | 9/1992 | Deul | 405/288 |
| 5,565,469 | 1/1986 | Chlumecky | 405/288 |

*Primary Examiner*—Dennis L. Taylor

*Attorney, Agent, or Firm*—Jon C. Christiansen; Daniel P. McCarthy

[57] ABSTRACT

A yieldable confined core mine roof support including a container and a filler placed within the container. The container is yieldable and the filler is compressible. The combination of a filler within a container produces a mine roof support which is yieldable under a substantially axial load and which increases in load carrying ability as it yields, impeding any decrease in the distance between a mine roof and a mine floor, minimizing or preventing mine roof collapse and mine floor heave, buckling or punching.

31 Claims, 2 Drawing Sheets

YIELDABLE CONFINED CORE MINE ROOF SUPPORT

BACKGROUND OF INVENTION

A. The Field of the Invention

This invention relates to the field of devices used to provide roof and floor support in underground mines, especially coal mines. The invention is particularly useful for areas which require substantial roof support and which may be in danger of roof cave-in, including areas where roof support by wood cribbing has typically been used. The invention also helps prevent and minimize floor heave or buckling of a mine floor. The primary application of the invention is expected to be in longwall mining. The invention also has application in any underground mine where common wood cribbing or other methods are presently used to support the mine roof. The invention is particularly useful in preventing, delaying, and/or controlling both mine roof collapse and mine floor heave, reducing underground mine fire danger, and facilitating air and traffic flow within a mine.

B. The Background Art

Various roof support devices in the prior art have been designed and used to provide support to the mine roof. Deep mining results in removal of material from the interior of a mine, leaving unsupported voids of various sizes within the mine which may be in danger of collapsing. It is desirable to provide support to the mine roof to prevent, delay, or control collapse. Further, it is desirable for the mine roof support to be such that travel within the mine is not unduly restricted, that air flow within the mine remains adequate to support human life and to remove exhaust gases of various machinery in use in the mine, and that the danger of fire within the mine is not increased.

One possible method of mine roof support is to leave internal pillars of rock, coal, ore or other material to support the mine roof. The pillars are material which would normally be removed from the mine but for the need to support the mine roof. This method for supporting a mine roof is undesirable because the material which must be left in the mine to form the supportive pillars is usually coal or ore and represents substantial economic value to the mine owner. Further, no support is found for the mine roof between pillars and there may still be substantial danger of mine roof collapse.

Wooden beams or timbers have also been used in the past to provide mine roof support wooden beams have a serious safety disadvantage in their inability to yield and absorb load from the mine roof. Instead, they have a tendency to unexpectedly snap under load giving way to a mine roof collapse. Wooden beams are also subject to weakening over time due to decomposition, drying, cracking and splitting. The fire danger within a mine is increased with the presence of wooden beams. Wooden beams supported with wooden posts are also susceptible to the problems stated above.

Wooden posts have been tried as mine roof supports, with varying degrees of success. Single and multiple (ganged) wooden posts, of various diameters may be cut to fit between the mine roof and floor. The posts are held tight with wooden wedges and header boards at the top and/or bottom of the posts. These wooden posts are susceptible to the problems listed above and to catastrophic buckling.

The closest prior art to the present invention in current use in the mining industry today is wood cribbing. Traditional wood cribbing typically uses overlapping layers of two or more rectangular wood blocks stacked on each other in alternating fashion from the mine floor to the mine roof to form a roof support which is square in cross section and generally open in the center. The wood blocks may be of various sizes, including standard 8"×8"×48". The advantage of standard wood cribbing over other prior art mine roof supports is its combination of yield range, load support capacity, and stability. Wood cribbing will typically support a mine roof and yield to the compressive force of the mine roof over a wider range than many other alternative prior art mine roof supports. Traditional wood cribbing may continue to prove some roof support when it is crushed up to approximately 40% of its initial height. As it compresses, wood cribbing has been found to experience an increase in load carrying capacity of up to 400%. Both of these are desirable characteristics in a mine roof support. Typically, wood cribbing structure will buckle when crushed from 20% to 40% of its initial height, if the height to width ratio is less than two. This results in total loss of support characteristics and can lead to roof collapse and floor heave.

Wood cribbing has been more predictable than many other types of prior art mine roof supports, being less likely to collapse unexpectedly. Wood cribbing, however is subject to weakening over time due to decomposition, drying and cracking or splitting, it requires the use of expensive and sometimes difficult to obtain wood products, it must be assembled from multiple pieces of wood within the mine using costly human labor, and it will burn during a mine fire. Further, the shape and size of traditional wood cribbing cause some undesirable restriction to both traffic and air flow within the mine. Wood may be replaced by material such as autoclaved aerated concrete and steel mesh to achieve more long-term durability and fire resistance, but the other problems associated with traditional wood cribbing remain and the cost and difficulty of installation are increased.

Variations of traditional wood cribbing include donut and disk cribbing which comprise multiple donut or disk-shaped members stacked from mine floor to mine roof. Examples of this are Chlumecky (U.S. Pat. Nos. 4,565,469 and 4,497,597) and Deul (U.S. Pat. No. 5,143,484). The stacked donuts or disks are typically made of steel reinforced concrete although it would be possible to construct them from wood or other materials. Concrete donuts or disks do not deteriorate as quickly as wood and will not burn, but they are subject to cracking and crumbling because they are only yieldable over a limited load range. Further, the disks or donuts are heavy and require substantial human labor to install. Donut or disk cribbing has the advantage, however, of more readily facilitating traffic within the mine than traditional wood cribbing and providing less resistance to air flow.

An alternative method of cribbing uses telescoping pipe with a material within the pipe to provide yieldable resistance against pressure from the mine roof. An example of this is Thorn (U.S. Pat. No. 4,712,947). As pressure from the mine roof increases, a beam, pole or pipe telescopes within another pipe as the material within the pipe is compressed to absorb load. This type of mine roof support is costly to use in large numbers because of the various custom metal parts which must be employed. This type of mine roof support is also subject to unexpected and severe buckling and collapse when it is stressed beyond the limits of its load range. Further, if wood is employed as a component, there is no reduction in fire danger within the mine.

SUMMARY OF THE INVENTION

It is an object of the invention to provide a mine roof support for use in underground mines where the mine roof may be in danger of roof cave-in. The invention is designed to provide support to the mine roof to prevent, delay, or control collapse and to eliminate or minimize mine floor heave or buckling. The primary function of the invention is to provide yieldable support under a load between a mine roof and a mine floor, whether the load is caused by a descending (or collapsing) mine roof or an ascending mine floor (such as due to floor heave or buckling). In this way, the invention impedes a decrease in the distance between mine roof and mine floor. The invention eliminates prior art problems of insufficient load holding capacity, inadequate support capacity versus yield variability, and inadequate load range before failure. To achieve these purposes, the invention will yield and absorb load from the mine roof with no tendency to unexpectedly snap under load giving way to a mine roof collapse. Buckling, crushing, breaking and block rolling are also eliminated or minimized. As load on the invention is increased and the invention yields under the load, there is an increase in the load carrying capacity of the invention due to the increasing density of the material comprising the invention as it yields. This results in a wide load range which the invention can accommodate while maintaining yield ability. Both the load range and the yield range of the invention are substantially greater than that of prior art mine roof supports. The invention eliminates unexpected and severe buckling and collapse when stressed beyond the limits of its load range, because it simply yields further upon itself, still providing roof support rather than buckling and falling away. This provides a predictable mine roof support because personnel working within the mine can visually observe the amount of yield of the invention, and hence the load applied to it and the likelihood that it may soon fail.

Another object of the invention is to provide a mine roof support which has the structural strength required to support the mine roof without punching a hole in the mine roof and/or mine floor. Many prior art mine roof supports which had ample structural strength failed due to punching a hole in the mine roof and/or mine floor. The invention yields under load so that excessive pressure on the mine roof and floor and the resulting punching are eliminated.

Another object of the invention is to provide a mine roof support which is not subject to weakening over time. The invention eliminates the use of materials which are subject to decomposition, drying and cracking or splitting and hence weakening over time as found in some prior art mine roof supports.

Another object of the invention is to provide a mine roof support which minimizes restriction of travel and restriction of access within the mine. The invention occupies minimal space within the mine, far less than traditional wood cribbing, and provides little impedance to traffic within the mine.

Another object of the invention is to provide a mine roof support which minimizes restriction of air flow within the mine, so that air flow remains adequate to support human life and to remove exhaust gases of various machinery in use in the mine. The preferred embodiment of the invention provides a mine roof support which has a rounded exterior surface, the least restrictive shape for accommodating air movement from any direction.

Another object of the invention is to provide a mine roof support which reduces the danger of fire within the mine. The preferred embodiment of the invention provides a mine roof support which substantially reduces fire danger compared to prior art mine roof supports.

Another object of the invention is to provide a mine roof support which is economical to manufacture and install, omitting custom-made components, multiple pieces, heavy articles, or costly materials, utilizing readily-available standard components, and not requiring substantial human labor to manufacture or install. Installation time is reduced due to the simplicity of the design of the invention. This results in a mine roof support which has a lower cost per unit of load supported and a lower overall cost per mine than prior art mine roof supports. A related advantage of the invention is increased safety for mine personnel due to elimination of most manual aspects of installation.

Another object of the invention is to reduce mine floor heave or buckling.

Further objects and advantages of the invention will become apparent to those skilled in the art.

DETAILED DESCRIPTION OF THE PREFERRED EMBODIMENT

Figure 1:
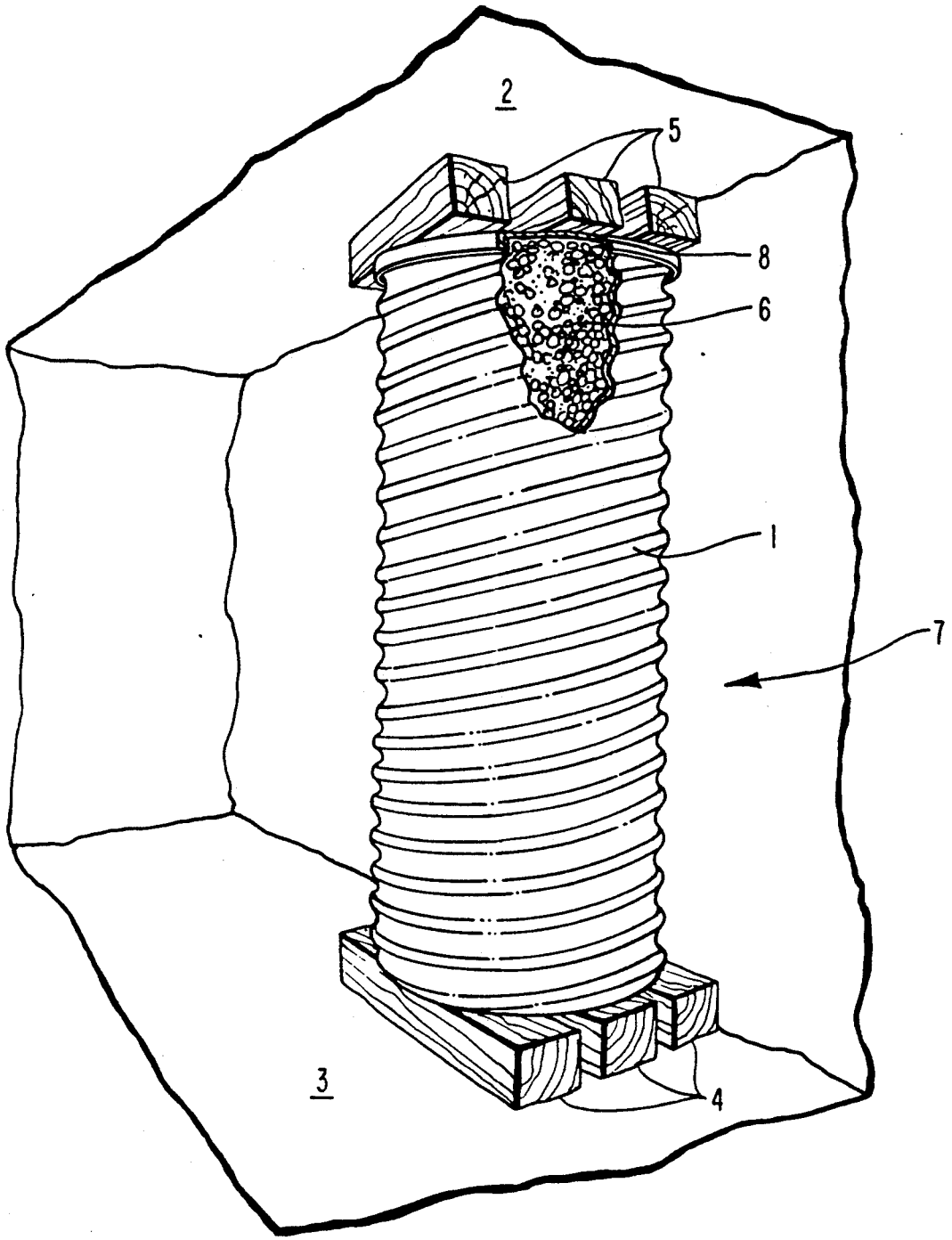
FIG. 1 depicts a cut-away perspective view of one preferred embodiment of the invention in use within an underground mine.

The invention is called a ,yieldable confined core mine roof support although it provides yieldable support to both a mine roof and to a mine floor. It comprises a compressible or crushable filler within a yieldable confining structure. Referring to FIG. 1, a cutaway perspective view of one preferred embodiment of the invention in use in an underground mine is depicted. Shown are the roof support 7, positioned longitudinally between the mine roof 2 and the mine floor 3. Footing material 4 and 5 is shown beneath and above the roof support 7, respectively, and can be used for levelling uneven mine surfaces for placement of the roof support 7 and for filling a void above a roof support 7. The footing material depicted in FIG. 1 is traditional wood cribbing, although many materials, including natural or man-made blocks, wedges, plates, donuts or other shapes would suffice. Foam injection may also be used to fill the void from the top of the container 1 to the mine roof 2. The footing material 4 is considered a means for levelling a roof support with a mine floor and the footing material 5 is considered a means for filling a void above a roof support 7.

The roof support 7 comprises a confining structure or container 1 surrounding a filler 6. The container 1 is considered means for surrounding, holding, confining or containing a filler. The container 1 is adapted to be placed with its longitudinal axis in substantially a vertical orientation between a mine floor and a mine roof. The container 7 would be considered to have its longitudinal axis in substantially a vertical orientation if it were perfectly vertical or angled up to 25 degrees or more to vertical. In some preferred embodiments of the invention, end caps 8 may be placed at either end of the container 1 to prevent escape of the filler 6. In one preferred embodiment of the invention, 0.25" steel plate is used for end cap material. In another preferred embodiment, 14 gauge steel is used for the end cap. Various other thicknesses of steel, other metals including aluminium, and other materials including wood, concrete, fiberglass, plastic, composite materials or others would be suitable for end caps and could perform equally well if configured to prevent escape of filler 6 from the container 1. End caps 8 are considered means for preventing escape of filler 6 from the container 1. The container 1 serves to at all times contain the filler 6. The combination of container 1 and filler 6 are yieldable to absorb and sustain load from the mine roof 2, and to prevent excessive pressure from being exerted on the mine roof 2 or mine floor 3 and thereby avoid punching. Yieldability and support characteristics of the roof support 7 also reduce or eliminate mine floor heave or buckling.

Figure 2:
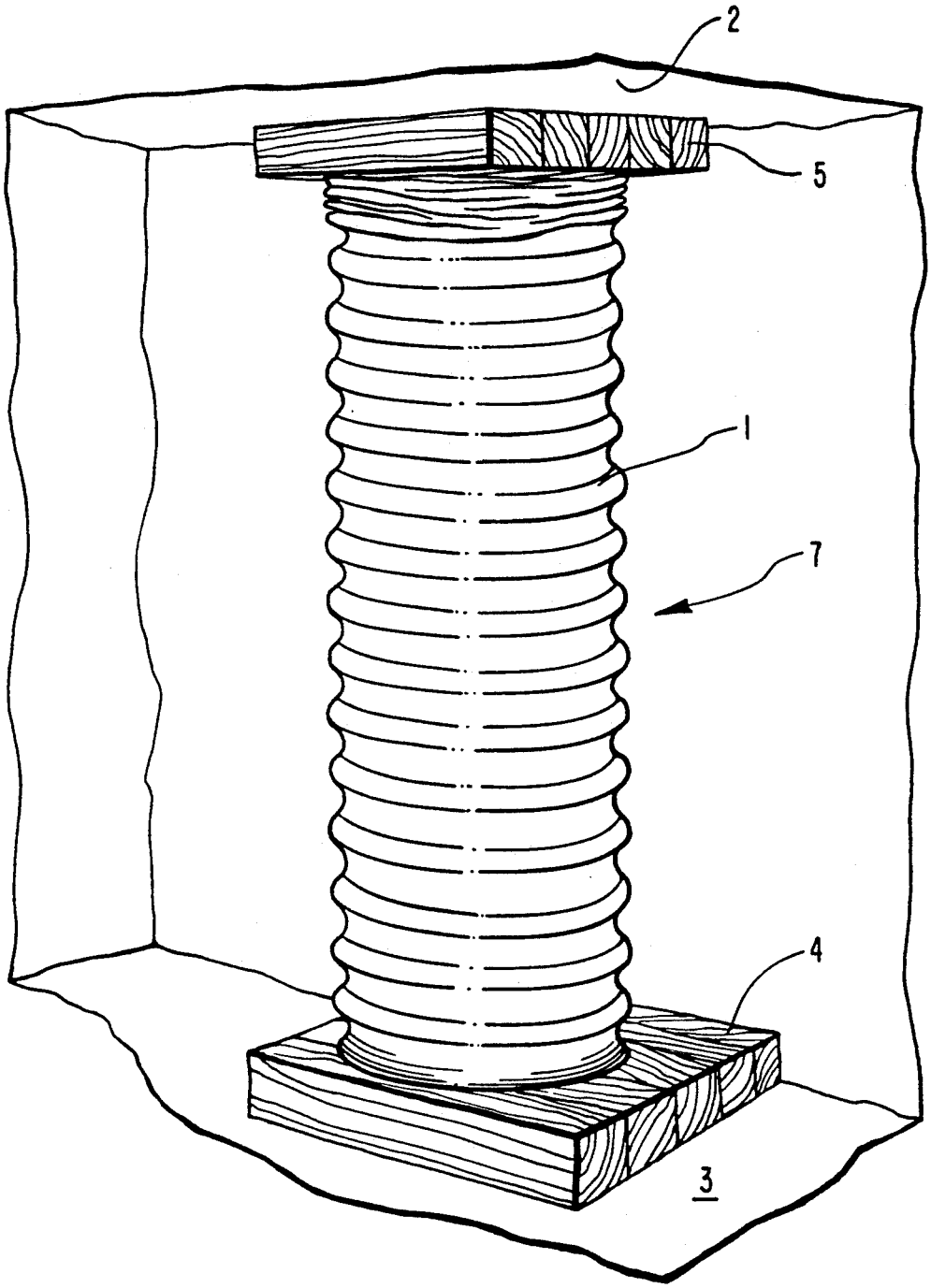
FIG. 2 depicts one preferred embodiment of the invention yielding under load from a mine roof.

Referring to FIG. 2, one preferred embodiment of the invention yielding under an axial load exerted by a descending mine roof or an ascending mine floor is depicted. The invention is expected to provide the same performance characteristics whether the load on the roof support 7 is from a descending mine roof (such as potential roof collapse) or from an ascending mine floor (such as floor heave or buckling). The container 1 has been partially compressed or folded down upon itself as it yielded and as the filler 6 was compressed in response to axial load from the mine roof 2. The entire invention yielded upon itself under a substantially axial load (i.e. load along the longitudinal axis of the invention, oriented vertically between mine floor and mine roof), and in so yielding, the combination of said container and said filler within said container provide continued yieldable support to said roof and impede its descent toward the mine floor. The invention provides the desired performance characteristics under any substantially axial load, a substantially axial load being any load along the axis of the container 1 or any load oriented up to 45 degrees from the axis of the container 1. An increase in load-carrying ability of the invention corresponds to such a yielding by the invention due to the increase in density of the filler 6 as it is compressed. An increase in load-carrying ability of several hundred percent due to yielding is typical. Although axial load on the invention beyond its load range will result in substantial crushing and an eventual decrease in load-carrying ability, rigorous laboratory and field testing have been unable to cause complete failure of the invention in any instance.

In a preferred embodiment, the invention yields upon itself in an accordion-like fashion under load. The combination of container 1 and filler 6 provides an invention which can accommodate a wide load range while maintaining yield ability, continuing to provide support to a mine roof even after yielding a substantial portion of its initial height and reducing risk of catastrophic failure. A further benefit is that the yieldability of the invention serves to minimize mine floor heave, buckling or punching which might otherwise occur with less yieldable roof supports.

In one preferred embodiment, the container 1 is made from cylindrical corrugated metal pipe which serves to provide a confining structure about the filler 6. Helical corrugation, as illustrated in FIG. 1, is used in one preferred embodiment of the invention. Annular corrugation, as illustrated in FIG. 2, is used in another preferred embodiment of the invention. If corrugated materials are selected for the container 1, then any corrugated material with sufficient strength, yield abilities, and proper dimensional characteristics could be used as the container 1. Because the container 1 serves as a confining structure, it must support the enclosed filler 6 and yield down upon itself under axial loading, similar to the compression of an accordion, without buckling or otherwise bending in an outward direction which would lead to roof support failure. Further, the container 1 must adequately contain the filler 6 when yielding under load. A container 1 which is subject to perforation, splitting or tearing thereby permitting escape of filler 6 would be considered inferior.

In alternative preferred embodiments, the container 1 may be made from material which is not corrugated. Any straight pipe which exhibits a tendency to yield upon itself under axial load rather than buckling could be used for the container 1. The container 1 need not necessarily be cylindrical either. A container of any shape with performance characteristics similar to those described above would be suitable. For example, the container 1 could be octagonal, hexagonal, pentagonal, square, triangular, spherical or otherwise. Alternatively, a container which is cylindrical and is corrugated along its longitudinal axis may also possess the desired performance characteristics.

The container 1 could also be constructed from wire mesh, a net-like structure, chain-link material, a lattice structure, or even stacks of new, blemished, or used tires if the desired performance characteristics are achieved. Another possible construction of the container would use composite or laminated materials, such as graphite or fiberglass composite employing a resin. This configuration would provide a lightweight container with substantial side, hoop or burst strength. In the preferred embodiment, cylindrical helically corrugated metal pipe provides optimum mine roof performance characteristics for the container while having the advantages of being non-flammable, providing less impedance to traffic within the mine, and providing less ventilation resistance than prior art wood cribbing. Experimental test results show corrugated metal pipe to be a suitable container. Further, corrugated metal pipe is a very inexpensive material commonly available and need not be custom manufactured, making the preferred embodiment of the invention an economical alternative to prior art mine roof supports.

Several types of containers have been tested successfully. Typically, 16 gauge, 14 gauge, 12 gauge, and 10 gauge helical and annular corrugated pipe which yields upon itself in an accordion-like fashion under axial load is preferred. Pipes with an inside and outside diameter of 42" and 48" have been found to be acceptable although others could be substituted. Depending on the type of mine, the type of mining equipment used, and the load support desired, containers could vary in diameter from less than 6 inches to more than 72 inches, and the thickness of the container wall could vary from less than 20 gauge to more than one-half inch thick. In one preferred embodiment, the container used is of 16 gauge steel and is 48", in diameter, for use in a mine with a nine foot high roof. In another preferred embodiment, the container used is 16 gauge steel and is 42" in diameter for use in a mine with a seven and a half foot high roof. Various other dimensions are possible for mine roofs which may range from less than 30" to more than 15 feet in height. Performance characteristics, cost and weight are expected to be the critical factors for selecting a container. Many containers or confining structures for filler 6 which is compressible under axial load could be acceptable for the container 1. In some preferred embodiments of the invention, the top and bottom of the container 1 are covered to prevent escape of filler 6 under load and loss of support characteristics. End caps 8 may be utilized for this purpose. For example, ¼' steel plate could be welded to or placed on the ends of container 1 as end caps 8. Wooden boards could be placed across the ends of the container 1, concrete disk cribbing could be placed over the ends of the container 1 or steel plate disks crimped over flanged end of container 1. Alternatively, concrete or steel disks could be placed inside with the ends of container 1 folded or crimped over the disks, or any other material or structure and attachment methods could be utilized as end caps 8 if the strength characteristics are adequate for preventing escape of filler 6 under load and during yield. In general, the preferred embodiment of the invention unitizes a container 1 which omits rivets which may break or pull through the container wall under stress. In some embodiments of the invention, however, rivets and/or container wall thickness and/or strength which resist pulling through the container wall under stress could be utilized. Similarly, any seams on the container 1 should exhibit sufficient strength to avoid rupture throughout the desired load and yield range.

When the roof support 7 is in use, a compressible or crushable filler 6 is found within the container 1. The filler 6 used in one preferred embodiment of the invention is minus three inch volcanic pumice. Other sizes of volcanic pumice can be used in other embodiments of the invention. Any material with the proper strength and compression or crushing characteristics to support the mine roof and mine floor while being subject to a wide load range could be used. The filler 6 should also avoid creating significant side or hoop stress under load. Some examples of other fillers known to be effective in varying degrees are chemical foams, cementitious foams, tires, coal and volcanic cinders. Other materials which may be used as fillers include fly ash, cinders, slag, limestone, gypsum, light and heavy aggregate, peralite, utelite, wood, rubber and others. Combinations of these and other materials could also be used to produce a filler with the density and compressibility desired. In the preferred embodiment, minus three inch volcanic pumice is used due its load range, compressibility, non-flammability, low cost, long-term durability, relatively light weight and availability.

In an alternative embodiment of the invention, the container is made from 54" inside diameter annular corrugated metal pipe with a 0.5" pipe nipple installed on the side for foam injection. The filler may be any of a variety of foams, but foams sold under the trade names Roklok and Tekfoam have shown satisfactory performance. The foam may be injected into the container before delivery to the mine, or it may be injected into the container during installation within the mine. Spiral corrugated metal pipe could be substituted for annular corrugated metal pipe in fabricating the container, or the container could be composed partially of spiral corrugated metal pipe and partially of annular corrugated metal pipe. Other containers with similar performance characteristics could also be used.

The invention described herein was designed and developed with many of the same key performance characteristics of traditional wood cribbing, but with substantial improvements incorporated to achieve a superior mine roof support far superior to those of the prior art. Experimental tests have shown the invention to have load holding capacities up to ten (10) times that of a standard wood crib and yield ranges more than double those of standard wood cribs. The invention comprises essentially two components, a container and filler. Elimination of multiple-component prior art mine roof support member reduces installation labor requirements and greatly reduces risk of injury to laborers installing the mine roof support. The invention also exhibits long-term durability characteristics desirable in underground mines. Mine roof supports subject to decomposition or other effects of age result in a mine which is dangerous and unpredictable. The invention's long-term durability and resistance to the effects of age brings about the added benefit of improving the safety of underground mines both during mining activity and thereafter.

In the preferred embodiment, the invention is used in the longwall tailgate entry of a mine. The roof support 7 may be installed in the headgate side (next panel's tailgate) of the longwall mining panel, prior to the longwall face passing any given location. The roof supports 7 will hold the entry open, prevent caving and resist abutment stresses on the headgate side. Even more critical, the roof supports 7 will hold the entry open when it becomes the tailgate entry of the next longwall panel as mining activity progresses, resisting abutment stresses by supporting the roof and floor and/or yielding and increasing support load capacity. Once the longwall has passed any given support, on the tailgate side, the roof supports 7 have performed their function and are no longer needed. In other applications, however, the roof supports 7 may be left in a mine under load for a number of years with no degradation of performance expected and continually providing roof support to permit traffic to move through the mine safely.

For installation, the roof support 7 may be transported underground and positioned with specialized equipment as a unit of container 1, filler 6, and end caps 8. End caps 8 may be omitted if an alternative means of preventing filler 6 from escaping from the container 1 under load is used. Alternatively, the various components of the roof support 7 may be transported into the mine separately and assembled on-site. During installation, the roof support 7 should be leveled at the base by levelling the mine floor 3 or by using various materials such as wood wedges to fill voids between the base of the roof support 7 and the mine floor 3. Wood cribbing may be used between the roof support 7 and the mine floor 3. Wood cribbing is typically used to fill any void between the top of the roof support 7 and the mine roof 2. Materials, other than wood, may be used as wedges and cribbing if they have similar performance characteristics.

While the present description has included specific examples and embodiments, it will be understood that there is no intent to limit the scope of the invention by such disclosure. Rather, the invention is intended to include all modifications, alternative constructions and equivalents falling within the spirit and scope of the invention as defined by the appended claims.

I claim:

1. A mine roof support comprising:

(a) a yieldable container having a longitudinal axis, said container being adapted to yield by folding upon itself under a load substantially along its longitudinal axis, and (b) a compressible filler within said container;

wherein said container is adapted to be placed with its longitudinal axis in substantially a vertical orientation between a mine roof and a mine floor; and wherein a combination of said container and said filler within said container is yieldable upon itself under a load exerted on said combination generally along the longitudinal axis of said container.

2. A mine roof support as recited in claim 1 wherein the yielding of said combination on said combination results in an increase in the load-carrying capacity of said combination.

3. A mine roof support as recited in claim 1, further comprising means for preventing escape of said filler from said container.

4. A mine roof support as recited in claim 3 wherein said means for preventing escape of filler from said container comprises an end cap.

5. A mine roof support as recited in claim 4 wherein said end cap comprises a plate.

6. A mine roof support as recited in claim 1, further comprising means for levelling said container with respect to a mine floor.

7. A mine roof support as recited in claim 6 wherein said levelling means comprises wood wedges.

8. A mine roof support as recited in claim 1, further comprising means for filling a void between the top of said container and a mine roof.

9. A mine roof support as recited in claim 8 wherein said void filling means comprises wood cribbing.

10. A mine roof support as recited in claim 1 wherein said container is corrugated.

11. A mine roof support as recited in claim 10 wherein said corrugations are helical.

12. A mine roof support as recited in claim 10 wherein said corrugations are annular.

13. A mine roof support as recited in claim 10 wherein said corrugated container is corrugated pipe.

14. A mine roof support as recited in claim 1 wherein said filler is volcanic pumice.

15. A mine roof support as recited in claim 1 wherein said filler is foam.

16. A mine roof support as recited in claim 1 wherein said container is non-flammable.

17. A mine roof support as recited in claim 1 wherein said filler is non-flammable.

18. A confined core mine roof support comprising:

(a) a yieldable container having a longitudinal axis, said container being adapted to yield by folding upon itself under an axial load, said container being adapted to be placed between a mine floor and a mine roof, and said container being adapted to sere as a confining structure for a filler, and (b) a compressible filler which may be placed within said container;

wherein said combination of container and filler is yieldable under a load exerted on said combination between a mine roof and a mine floor substantially along the longitudinal axis of said container, and during yielding, said combination provides continued yieldable support to the mine roof and mine floor and impedes convergence of mine roof with mine floor.

19. A mine roof support as in claim 18 wherein the yielding of said combination results in an increase in the load-carrying capacity of said combination.

20. A mine roof support as in claim 19 wherein said filler is selected from the group consisting of volcanic pumice and foam.

21. A mine roof support as recited in claim 18 wherein said container comprises corrugated steel.

22. A mine roof support comprising:

(a) a yieldable corrugated container being adapted to yield by folding upon itself at its corrugations when placed under a load, said container also being adapted to serve as a confining structure for a filler, (b) compressible foam filler which may be placed into said container;

wherein said container is adapted to be placed between a mine roof and a mine floor; and wherein a combination of said container and said filler within said container is yieldable under a load exerted upon said combination between a mine roof and a mine floor, and in yielding, said combination provides continued yieldable support to the mine roof and mine floor and impedes convergence of the mine roof with the mine floor.

23. A mine roof support as recited in claim 22 wherein the yielding of said combination in response to a load results in an increase in the load-carrying capacity of said combination.

24. A mine roof support system for impeding convergence of a mine roof with a mine floor comprising:

(a) a yieldable corrugated container having a longitudinal axis, said container being adapted to yield by folding upon itself at its corrugations when placed under a load generally along its longitudinal axis, said container being adapted to serve as a confining structure for a filler, and said container being adapted to be placed in an underground mine between the mine roof and the mine floor, (b) compressible filler within said container, (c) means for levelling said container with respect to the mine floor, and (d) means for filling a void between the top of said container and the mine roof;

wherein a combination of said container and said filler within said container is yieldable upon itself under a load exerted on said combination generally along the longitudinal axis of said container; and wherein yielding of said combination results in an increase in its load carrying ability.

25. A mine roof support as recited in claim 24 wherein the yielding of said combination results in an increase in the load-carrying capacity of said combination.

26. A mine roof support as recited in claim 25 wherein said void filling means comprises foam.

27. A mine roof support as recited in claim 25 wherein said filler is selected from the group consisting of volcanic pumice and foam.

28. A mine roof support as recited in claim 25 wherein said container is corrugated pipe.

29. A mine roof support as recited in claim 28 wherein said container comprises steel.

30. A mine roof support as recited in claim 29 wherein said filler is volcanic pumice.

31. A mine roof support system for impeding a decrease in the distance between a mine roof and a mine floor, the support system comprising:

(a) a yieldable confining structure being adapted to yield by folding upon itself under load, being adapted to contain a filler, and being adapted to be placed in an underground mine between the mine roof and the mine floor, and (b) compressible filler which may be placed within said confining structure;

wherein a combination of said confining structure and said filler within said confining structure is yieldable upon itself under a load exerted on said combination.

* * * * *

UNITED STATES PATENT AND TRADEMARK OFFICE

CERTIFICATE OF CORRECTION

PATENT NO. : 5,308,196
DATED : May 3, 1994
INVENTOR(S) : John R. Frederick

It is certified that error appears in the above-indentified patent and that said Letters Patent is hereby corrected as shown below:

Column 9, line 54, "sere" should be --serve --.

Signed and Sealed this

Seventh Day of March, 1995

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,308,196

DATED : May 3, 1994

INVENTOR(S) : John R. Frederick

It is certified that error appears in the above-indentified patent and that said Letters Patent is hereby corrected as shown below:

Column 2, line 16, "prove" should be --provide --.

Column 2, line 23, "less" should be --greater --.

Signed and Sealed this

Second Day of May, 1995

*Attest:*

Bruce Lehman

BRUCE LEHMAN

*Attesting Officer*

*Commissioner of Patents and Trademarks*

US005308196B1

REEXAMINATION CERTIFICATE (3790th)

United States Patent [19]

Frederick

[11] B1 5,308,196

[45] Certificate Issued Jun. 22, 1999

[54] YIELDABLE CONFINED CORE MINE ROOF SUPPORT

[75] Inventor: John R. Frederick, Aurora, Utah

[73] Assignee: The Coastal Corporation, Houston, Tex.

Reexamination Request:
No. 90/004,614, May 2, 1997

Reexamination Certificate for:

| | |
|---|---|
| Patent No.: | **5,308,196** |
| Issued: | **May 3, 1994** |
| Appl. No.: | **08/035,722** |
| Filed: | **Mar. 23, 1993** |

Certificate of Correction issued Mar. 7, 1995.

Certificate of Correction issued May 2, 1995.

[51] Int. Cl.[6] ..... E21D 11/00; E21D 15/02

[52] U.S. Cl. ..... 405/288; 248/354.2; 405/289; 405/303

[58] Field of Search ..... 248/354.2; 405/288, 405/289, 290, 303

[56] References Cited

U.S. PATENT DOCUMENTS

| | | |
|---|---|---|
| 31,777 | 3/1861 | Boynton . |
| 82,663 | 9/1868 | Walters et al. . |
| 87,016 | 2/1869 | Walters et al. . |

(List continued on next page.)

FOREIGN PATENT DOCUMENTS

| | | |
|---|---|---|
| 76/3597 | 8/1977 | South Africa . |
| 76/3598 | 8/1977 | South Africa . |
| 78/7331 | 12/1979 | South Africa . |
| 80/6944 | 10/1980 | South Africa . |
| 806944 | 11/1980 | South Africa . |
| 86/0510 | 1/1986 | South Africa . |
| 90/1210 | 9/1990 | South Africa . |
| 91/0910 | 9/1991 | South Africa . |
| 91/5093 | 9/1992 | South Africa . |

OTHER PUBLICATIONS

Yieldable In–Place Prop Insert by Western Support Systems.
Hydracrib by Gary A. Towne, Ephraim, Utah.
Dywidag Coal Post by Dywidag Systems International.
BTS Packing Material Telescopic Prop by Advanced Mining Technology, Inc.
Dosco/Bullflex—The Alternative Crib by The Dosco Corporation.
Donut Cribbing by Commercial Shearing, Inc.
Durox Stratablocs by Aerated Concrete Ltd.
Donut Cribbing by Nicholas Chlumecky and Ronald Smith.
Seegmiller, Ben L., "Compression–Yield Roof Support Concept Using a New Yieldable Steel Prep." presented at the SME Annual Meeting Specialty Symposium "New Technology in Mine Health and Safety," Feb. 24–27, 1992.
Skinner, U.S. Bureau of Mines, *Structural Uses and Placement Techniques for Lightweight Concrete in Underground Mining,* 1989.
"Molded Concrete Center Mine Wall," NASA Tech Briefs, Mar. 1987.
Strata Blocs, Advertisement from Aerated Concrete Ltd. dated by letter from Ken Wallace to Mr. Frederick, 1987.
"Stopping Squeezes But Doesn't Break," *Coal Age,* Feb. 1986.
Advertisement for Monier Resources Big Bag Chocks (enclosed in letter from Pamela M. Schilt to Ros Hill, Jan. 22, 1986).
Van Vlack, Lawrence H., *Elements of Materials Science and Engineering,* 3rd Edition, pp. 8, 482, (1975).

(List continued on next page.)

*Primary Examiner*—John Ricci

[57] ABSTRACT

A yieldable confined core mine roof support including a container and a filler placed within the container. The container is yieldable and the filler is compressible. The combination of a filler within a container produces a mine roof support which is yieldable under a substantially axial load and which increases in load carrying ability as it yields, impeding any decrease in the distance between a mine roof and a mine floor, minimizing or preventing mine roof collapse and mine floor heave, buckling or punching.

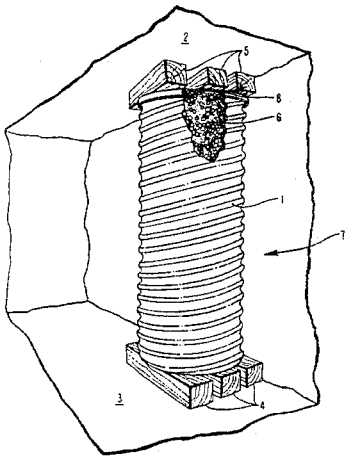

U.S. PATENT DOCUMENTS

| | | | |
|---|---|---|---|
| 456,646 | 7/1891 | Clark . | |
| 614,729 | 11/1898 | Lally . | |
| 881,609 | 3/1908 | Nellen et al. . | |
| 987,397 | 3/1911 | Pittroff . | |
| 1,895,053 | 1/1933 | Staley . | |
| 1,971,051 | 5/1934 | Reiner et al. . | |
| 2,510,688 | 6/1950 | Evans et al. | 248/354 |
| 3,188,041 | 6/1965 | Town | 248/356 |
| 3,196,061 | 7/1965 | Paulson et al. | 156/63 |
| 3,648,960 | 3/1972 | Krekeler | 248/356 |
| 4,185,940 | 1/1980 | Spies | 405/288 |
| 4,195,111 | 3/1980 | Rautenbach | 428/218 |
| 4,249,837 | 2/1981 | Spies | 405/290 |
| 4,255,071 | 3/1981 | Koppers et al. | 405/290 |
| 4,277,204 | 7/1981 | Koppers et al. | 405/288 |
| 4,309,059 | 1/1982 | Walsh | 299/11 |
| 4,425,057 | 1/1984 | Hahn | 405/258 |
| 4,497,597 | 2/1985 | Chlumecky | 405/288 |
| 4,565,469 | 1/1986 | Chlumecky | 405/288 |
| 4,664,563 | 5/1987 | Christman | 405/288 |
| 4,712,947 | 12/1987 | Thom | 405/288 |
| 4,726,714 | 2/1988 | MacArthur | 405/290 |
| 4,770,564 | 9/1988 | Dison | 405/288 |
| 4,773,792 | 9/1988 | Landers | 405/230 |
| 4,983,077 | 1/1991 | Sorge et al. | 405/288 |
| 5,013,157 | 5/1991 | Mills et al. | 366/13 |
| 5,143,340 | 9/1992 | Wood et al. | 248/354.2 |
| 5,143,484 | 9/1992 | Deul | 405/288 |
| 5,273,378 | 12/1993 | Merz et al. | 405/290 |
| 5,342,150 | 8/1994 | Kitchen | 405/288 |
| 5,400,994 | 3/1995 | Shawwaf et al. | 248/354.3 |

OTHER PUBLICATIONS

Emanuele Fumagalli, "Tests on Cohesionless Materials for Rockfill Dams," *Journal of the Soil Mechanics and Foundations Division,* Proceedings of the American Society of Civil Engineers, Jan. 1969.

John J. Reed & C. David Mann, "Full Scale Testing Develops Efficient Preloaded Concrete Pillars," *Journal of the American Concrete Institute,* Nov. 1961.

W. Lohr, "Concrete Columns Encased in Steel Shells Proposed," published in *Engineering News–Record,* Dec. 13, 1934.

John Stephen Sewell, "Columns for Buildings," *Engineering News,* Oct. 23, 1902.

Dosco/Bullflex—The Alternative Crib.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 1, lines 50–60:

Wooden beams or timbers have also been used in the past to provide mine roof support[w]. *W*ooden beams have a serious safety disadvantage in their inability to yield and absorb load from the mine roof. Instead, they have a tendency to unexpectedly snap under load giving way to mine roof collapse. Wooden beams are also subject to weakening over time due to decomposition, drying, cracking and splitting. The fire danger within a mine is increased with the presence of wooden beams. Wooden beams supported with wooden posts are also susceptible to the problems stated above.

Column 2, line 59–column 3, line 4:

An alternative method of cribbing uses telescoping pipe with a material within the pipe to provide yieldable resistance against pressure from the mine roof. An example of this is Tho[rn]*m* (U.S. Pat. No. 4,712,947). As pressure from the mine roof increases, a beam, pole or pipe telescopes within another pipe as the material within the pipe is compressed to absorb load. This type of mine roof support is costly to use in large numbers because of the various custom metal parts which must be employed. This type of mine roof support is also subject to unexpected and severe buckling and collapse when it is stressed beyond the limits of its load range. Further, if wood is employed as a component, there is no reduction in fire danger within the mine.

Column 3, lines 7–43:

It is an object of the invention to provide a mine roof support for use in underground mines where the mine roof may be in danger of roof cave-in. The invention is designed to provide support to the mine roof to prevent, delay, or control collapse and to eliminate or minimize mine floor heave or buckling. The primary function of the invention is to provide yieldable support under a load between a mine roof and a mine floor, whether the load is caused by a descending (or collapsing) mine roof or an ascending mine floor (such as due to floor heave or buckling). In this way, the invention impedes a decrease in the distance between mine roof and mine floor. The invention eliminates prior art problems of insufficient load holding capacity, inadequate support capacity versus yield variability, and inadequate load range before failure. To achieve these purposes, the invention will yield and absorb load from the mine roof with no tendency to unexpectedly snap under load giving way to a mine roof collapse. Buckling, crushing, breaking and block rolling are also eliminated or minimized. As load on the invention is increased and the invention yields under the load, there is an increase in the load carrying capacity of the invention due to the increasing density of the material comprising the invention as it yields. This results in a wide load range which the invention can accommodate while maintaining yield[ ]ability. Both the load range and the yield range of the invention are substantially greater than that of prior art mine roof supports. The invention eliminates unexpected and severe buckling and collapse when stressed beyond the limits of its load range, because it simply yields further upon itself, still providing roof support rather than buckling and falling away. This provides a predictable mine roof support because personnel working within the mine can visually observe the amount of yield of the invention, and hence the load applied to it and the likelihood that it may soon fail.

Column 5, lines 53–63:

In a preferred embodiment, the invention yields upon itself in an accordion-like fashion under load. The combination of container 1 and filler 6 provides an invention which can accommodate a wide load range while maintaining yield[ ]ability, continuing to provide support to a mine roof even after yielding a substantial portion of its initial height and reducing risk of catastrophic failure. A further benefit is that the yieldability of the invention serves to minimize mine floor heave, buckling or punching which might otherwise occur with less yieldable roof supports.

Column 7, lines 30–51:

When the roof support 7 is in use, a compressible or crushable filler 6 is found within the container 1. The filler 6 used in one preferred embodiment of the invention is minus three inch volcanic pumice. Other sizes of volcanic pumice can be used in other embodiments of the invention. Any material with the proper strength and compression or crushing characteristics to support the mine roof and mine floor while being subject to a wide load range could be used. The filler 6 should also avoid creating significant side or hoop stress under load. Some examples of other fillers known to be effective in varying degrees are chemical foams, cementitious foams, tires, coal and volcanic cinders. Other materials which may be used as fillers include fly ash, cinders, slag, limestone, gypsum, light and heavy aggregate, per[a]lite, utelite, wood, rubber and others. Combinations of these and other materials could also be used to produce a filler with the density and compressibility desired. In the preferred embodiment, minus three inch volcanic pumice is used due its load range characteristics, compressibility characteristics, non-flammability, low cost, long-term durability, relatively light weight and availability.

AS A RESULT OF REEXAMINATION, IT HAS BEEN DETERMINED THAT:

Claims 1–31 are cancelled.

New claim 32 is added and determined to be patentable.

*32. A mine roof support for impeding convergence between a mine roof and a mine floor comprising:*

*a yieldable container having a longitudinal axis, said yieldable container being adapted to be placed between a mine roof and a mine floor in an orientation such that the longitudinal axis of said yieldable container is generally oriented in the direction of expected convergence between a mine roof and a mine floor, said yieldable container being configured to serve as a confining structure for a filler placed within said container, and said yieldable container being yieldable under a load exerted on said yieldable container along its longitudinal axis so that over time and under sufficient load said yieldable container will yield upon itself and decrease in length in the direction of its longitudinal axis in response to said load;*

*a compressible filler disposable within said container, said compressible filler being compressible under a*

*load, and said compressible filler achieving compressibility by trapped gas existing within said filler;*

*wherein said compressible filler and said yieldable container act in concert with each other under a load exerted along the longitudinal axis of said yieldable container in a manner such that as said compressible filler is compressed under load, said yieldable container substantially confines said compressible filler within the interior of said yieldable container in order to reduce escape of compressible filler from the interior of said yieldable container;*

*wherein said compressible filler and said yieldable container act in concert with each other under a load exerted along the longitudinal axis of said yieldable container in a manner such as said compressible filler is compressed under load, as said compressible filler is confined within said yieldable container, and as said yieldable container yields under load and decreases in length along its longitudinal axis, the effective load carrying capacity of the mine roof support increases;*

*wherein as said compressible filler is compressed under load, said compressible filler gains compressive strength;*

*wherein as said yieldable container yields and decreases in length along its longitudinal axis in response to a load exerted along its longitudinal axis, said yieldable container experiences an increase in effective wall thickness per unit of length of said yieldable container;*

*wherein said yieldable container yields in response to a load exerted along its longitudinal axis by folding upon itself; and*

*wherein the mine roof support derives the ability to impede convergence between a mine roof and a mine floor from the combination of said compressible filler and said yieldable container acting in concert with each other rather than from either of said yieldable container and said compressible filler individually, and said filler increasing in load bearing capacity with increasing compression.*

* * * * *

US005308196C2

(12) EX PARTE REEXAMINATION CERTIFICATE (7282nd)

United States Patent
Frederick

(10) Number: US 5,308,196 C2
(45) **Certificate Issued: *Dec. 29, 2009**

(54) YIELDABLE CONFINED CORE MINE ROOF SUPPORT

(75) Inventor: John R. Frederick, Aurora, UT (US)

(73) Assignee: The Coastal Corporation, Houston, TX (US)

Reexamination Request:
No. 90/006,019, May 25, 2001

Reexamination Certificate for:

| | |
|---|---|
| Patent No.: | **Re. 308,196** |
| Issued: | **May 3, 1994** |
| Appl. No.: | **08/035,722** |
| Filed: | **Mar. 23, 1993** |

Reexamination Certificate B1 5,308,196 issued Jun. 22, 1999

( * ) Notice: This patent is subject to a terminal disclaimer.

Certificate of Correction issued Mar. 7, 1995.

Certificate of Correction issued May 2, 1995.

(51) Int. Cl.

| | |
|---|---|
| ***E21D 15/48*** | (2006.01) |
| ***E21D 15/00*** | (2006.01) |
| ***E21D 15/02*** | (2006.01) |
| ***E21D 11/00*** | (2006.01) |

(52) U.S. Cl. ..... 405/288; 248/354.2; 405/289; 405/303

(58) Field of Classification Search ..... None
See application file for complete search history.

(56) References Cited

U.S. PATENT DOCUMENTS

| | | | | |
|---|---|---|---|---|
| 4,052,029 A | 10/1977 | Townsend | ..... | 248/356 |
| 4,770,564 A | 9/1988 | Dison | ..... | 405/288 |

FOREIGN PATENT DOCUMENTS

| | | |
|---|---|---|
| EP | 0040096 A1 * | 11/1981 |
| ZA | 76/3597 | 6/1976 |
| ZA | 76/3598 | 6/1976 |
| ZA | 78/7331 | 12/1979 |
| ZA | 90/1210 | 2/1990 |
| ZA | 91/0910 | 2/1991 |
| ZA | 91/5093 | 2/1991 |

OTHER PUBLICATIONS

"New Products from Coal Combustion Ash: Selective Extraction of Particles with Density <2" from www.flyash-.info viewed Dec. 2005.*

Yao, J.C., "Buckling of Axially Compressed Long Cylindrical Shell With Elastic Core"; *Journal of Applied Mechanics*; No. 2; pp. 329–334 (Jun. 1962).

Timoshenko, Stephen and Gere, James M.; *Theory of Elastic Stability* (2nd ed.); McGraw–Hill Book Company, New York; pp. 457 and 461 (1961).

Batterman, S.C.; "Plastic Buckling of Axially Compressed Cylindrical Shells"; *AIAA Journal*; vol. 3, No. 2; pp. 316, 317, and 325 (1964).

Pugsley & Macauly; "The Large–scale Crumpling of Thin Cylindrical Columns"; *Quarterly Journal of Mechanics and Applied Mathematics*; vol. 13, Part 1; pp. 1–9; (1960).

Alexander, J.M., "An Approximate Analysis of the Collapse of Thin Cylindrical Shells Under Axial Loading"; *Quarterly Journal of Mechanics and Applied Mathematics*; vol. 13, Part 1; pp. 10–15 (1960).

* cited by examiner

*Primary Examiner*—Peter C. English

(57) ABSTRACT

A yieldable confined core mine roof support including a container and a filler placed within the container. The container is yieldable and the filler is compressible. The combination of a filler within a container produces a mine roof support which is yieldable under a substantially axial load and which increases in load carrying ability as it yields, impeding any decrease in the distance between a mine roof and a mine floor, minimizing or preventing mine roof collapse and mine floor heave, buckling or punching.

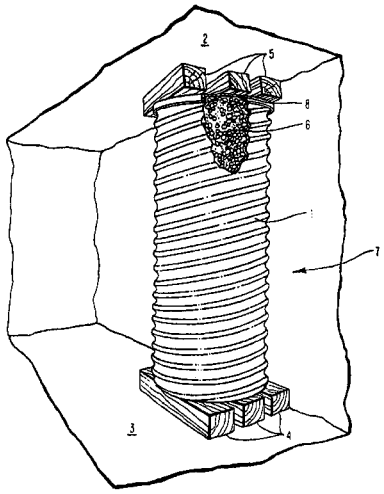

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 5, lines 53–63:

In a preferred embodiment, the invention yields upon itself in an accordion-like fashion under load *that increases the effective wall thickness per unit length of the container 1*. The combination of container 1 and filler 6 provides an invention which can accommodate a wide load range while maintaining yieldability, continuing to provide support to a mine roof even after yielding a substantial portion of its initial height and reducing risk of catastrophic failure. A further benefit is that the yieldability of the invention serves to minimize mine floor heave, buckling or punching which might otherwise occur with less yieldable roof supports.

Column 6, line 50–column 7, line 29:

Several types of containers have been tested successfully. Typically, 16 gauge, 14 gauge, 12 gauge, and 10 gauge helical and annular corrugated pipe which yields upon itself in an accordion-like fashion under axial load is prefered. Pipes with an inside and outside diameter of 42" and 48" have been found to be acceptable although others could be substituted. Depending on the type of mine, the type of mining equipment used, and the load support desired, containers could vary in diameter from less than 6 inches to more than 72 inches, and the thickness of the container wall could vary from less than 20 gauge to more than one-half inch thick. In one preferred embodiment, the containers used is of 16 gauge steel and is 48"[.] in diameter, for use in a mine with a nine foot high roof. In another preferred embodiment, the container used is 16 gauge steel and is 42" in diameter for use in a mine with a seven and a half foot high roof. Various other dimensions are possible for mine roofs which may range from less than 30" to more than 15 feet in height. Performance characteristics, cost and weight are expected to be the critical factors for selecting a container. Many containers or confining structures for filler 6 which is compressible under axial load could be acceptable for the container 1. In some preferred embodiments of the invention, the top and bottom of the container 1 are covered to prevent escape of filler 6 under load and loss of support characteristics. End caps 8 may be utilized for this purpose. For example, ¼[']" steel plate could be welded to or placed on the ends of container 1 as end caps 8. Wooden boards could be placed across the ends of the container 1, concrete disk cribbing could be placed over the ends of the container 1 or steel plate disks crimped over flanged end of container 1. Alternatively, concrete or steel disks could be placed inside with the ends of container 1 folded or crimped over the disks, or any other material or structure and attachment methods could be utilized as end caps 8 if the strength characteristics are adequate for preventing escape of *the* filler 6 under load and during yield. *In any event, when end caps are utilized, the end caps 8 and the filler 6 do not operate to pre-tension the container 1 along it longitudinal axis when the container is operatively positioned.* In general, the prefererd embodiment of the invention [unitizes] *utilizes* a container 1 which omits rivets which may break or pull through the container wall under stress. In some embodiments of the invention, however, rivets and/or container wall thickness and/or strength which resist pulling through the container wall under stress could be utilized. Similarly, any seams on the container 1 should exhibit sufficient strength to avoid rupture throughout the desired load and yield range.

AS A RESULT OF REEXAMINATION, IT HAS BEEN DETERMINED THAT:

Claims 1–31 were previously cancelled.

Claim 32 is cancelled.

New claims 33–54 are added and determined to be patentable.

*33. A mine roof support for impeding convergence between a mine roof and a mine floor comprising;*

*a yieldable container having a longitudinal axis, said yieldable container being adapted to be placed between a mine roof and a mine floor in an orientation such that the longitudinal axis of said yieldable container is generally oriented in the direction of expected convergence between a mine roof and a mine floor, said yieldable container being configured to serve as a confining structure for a filler placed within said container, and said yieldable container being yieldable under a load exerted on said yieldable container along its longitudinal axis so that over time and under sufficient load said yieldable container will yield upon itself and decrease in length in the direction of its longitudinal axis in response to said load;*

*a compressible filler disposed within said container, said compressible filler being compressible under a load and said compressible filler achieving compressibility by trapped gas existing within said filler and said compressible filler not pre-tensioning said yieldable container along said longitudinal axis when the container is operatively positioned;*

*wherein said compressible filler and said yieldable container act in concert with each other under a load exerted along the longitudinal axis of said yieldable container in a manner such that as said compressible filler is compressed under a load, said yieldable container substantially confines said compressible filler within the interior of said yieldable container in order to reduce escape of compressible filler from the interior of said yieldable container;*

*wherein said compressible filler and said yieldable container act in concert with each other under a load exerted along the longitudinal axis of said yieldable container in a manner such as said compressible filler is compressed under load, as said compressible filler is confined within said yieldable container, and as said yieldable container yields under load and decreases in length along its longitudinal axis, the effective load carrying capacity of the mine roof support increases;*

*wherein as said compressible filler is compressed under load, said compressible filler gains compressive strength;*

*wherein as said yieldable container yields and decreases in length along its longitudinal axis in response to a*

*load exerted along its longitudinal axis, said yieldable container experiences an increase in effective wall thickness per unit length of said yieldable container;*

*wherein said yieldable container yields in response to a load exerted along its longitudinal axis by folding upon itself; and*

*wherein the mine roof support derives the ability to impede convergence between a mine roof and a mine floor from the combination of said compressible filler and said yieldable container acting in concert with each other rather than from either of said yieldable container and said compressible filler individually, and said filler increasing in load capacity with increasing compression.*

*34. A mine roof support as recited in claim 33 further comprising end caps for said container with said end caps serving to prevent escape of said compressible filler from said container.*

*35. A mine roof support as recited in claim 34 wherein said end caps are made of one metal plate and cement plate.*

*36. A mine roof support as recited in claim 33 wherein said container is at least partially constructed with straight walls.*

*37. A mine roof support for impeding convergence between a mine roof and a mine floor comprising;*

*a yieldable container having a longitudinal axis, said yieldable container being adapted to be placed between a mine roof and a mine floor in an orientation such that the longitudinal axis of said yieldable container is generally oriented in the direction of expected convergence between a mine roof and a mine floor, said yieldable container being configured to serve as a confining structure for a filler placed within said container, and said yieldable container being yieldable under a load exerted on said yieldable container along its longitudinal axis so that over time and under sufficient load said yieldable container will yield upon itself and decrease in length in the direction of its longitudinal axis in response to said load, and*

*a compressible filler disposed within said container, said compressible filler being compressible under a load, and said compressible filler achieving compressibility by trapped gas existing within said filler and said compressible filler not pre-tensioning said yieldable container along said longitudinal axis when the container is operatively positioned;*

*wherein said filler is crushable;*

*wherein said filler is non-flammable;*

*wherein said compressible filler and said yieldable container act in concert with each other under a load exerted along the longitudinal axis of said yieldable container in a manner such that as said compressible filler is compressed under load, said yieldable container substantially confines said compressible filler within the interior of said yieldable container in order to reduce escape of compressible filler from the interior of said yieldable container;*

*wherein said compressible filler and said yieldable container act in concert with each other under a load exerted along the longitudinal axis of said yieldable container in a manner such as said compressible filler is compressed under load, as said compressible filler is confined within said yieldable container, and as said yieldable container yields under load and decreases in length along its longitudinal axis, the effective load carrying capacity of mine roof support increase;*

*wherein as said compressible filler is compressed under load, said compressible filler gains compressive strength;*

*wherein as said yieldable container yields and decreases in length along its longitudinal axis in response to a load exerted along its longitudinal axis, said yieldable container experiences an increase in effective wall thickness per unit of length of said yieldable container;*

*wherein said yieldable container yields in response to a load exerted along its longitudinal axis by folding upon itself; and*

*wherein the mine roof support derives the ability to impeded convergence between a mine roof and a mine floor from the combination of said compressible filler and said yieldable container acting in concert with each other rather than from either of said yieldable container and said compressible filler individually, and said filler increasing in load bearing capacity with increasing compression.*

*38. A mine roof support as recited in claim 37 wherein said container serves as a means for holding and confining said filler.*

*39. A mine roof support as recited in claim 38 further comprising end caps for said container, said end caps being selected from the group consisting of metal plate and cement plate, and said end caps serving to prevent escape of filler from said container.*

*40. A mine roof support as recited in claim 37 wherein said filler and said container are yieldable in a manner that tends to absorb and sustain load and prevent excessive pressure from being exerted on a mine floor or a mine roof, thereby avoiding punching through a mine floor or a mine roof.*

*41. A mine roof support as recited in claim 37 wherein said container folds down upon itself as it yields under load.*

*42. A mine roof support as recited in claim 37 wherein said container yields by folding in an accordion-like fashion.*

*43. A mine roof support as recited in claim 37 wherein said filler increases in density as it is compressed.*

*44. A mine roof support as recited in claim 37 wherein the mine roof support has the ability to yield for a substantial portion of height without experiencing catastrophic failure.*

*45. A mine roof support as recited in claim 37 wherein said container is at least partially constructed with straight walls.*

*46. A mine roof support as recited in claim 37 wherein said container has substantial side hoop and burst strength.*

*47. A mine roof support for impeding convergence between a mine roof and a mine floor comprising;*

*a yieldable container having a longitudinal axis, said yieldable container being adapted to be placed between a mine roof and a mine floor in an orientation such that the longitudinal axis of said yieldable container is generally oriented in the direction of expected convergence between a mine roof and a mine floor, said yieldable container being configured to serve as a confining structure for a filler placed within said container, and said yieldable container being yieldable under a load exerted on said yieldable container along its longitudinal axis so that over time and under sufficient load said yieldable container will yield upon itself and decrease in length in the direction of its longitudinal axis in response to said load; and*

*a compressible filler disposed within said container, said compressible filler being compressible under a load and said compressible filler achieiving compressibility*

*by trapped gas existing within said filler and said compressible filler not pre-tensioning said yieldable container along said longitudinal axis when the container is operatively positioned;*

*wherein said container serves as a means for holding and confining said filler;*

*wherein said filler and said container are yieldable in a manner that tends to absorb and sustain load and prevent excessive pressure from being exerted on a mine floor or a mine roof, thereby avoiding punching through a mine floor or a mine roof;*

*wherein said container folds down upon itself as it yields under load;*

*wherein said filler increases in density as it is compressed;*

*wherein said container has substantial side, hoop and burst strength;*

*wherein said compressible filler and said yieldable container act in concert with each other under a load exerted along the longitudinal axis of said yieldable container in a manner such that as said compressible filler is compressed under load, said yieldable container substantially confines said compressible filler within the interior of said yieldable container in order to reduce escape of compressible filler from the interior of said yieldable container;*

*wherein said compressible filler and said yieldable container act in concert with each other under a load exerted along the longitudinal axis of said yieldable container in a manner such as said compressible filler is compressed under load, as said compressible filler is confined within said yieldable container, and as said yieldable container yields under load and decreases in length along its longitudinal axis, the effective load carrying capacity of the mine roof support increase;*

*wherein as said compressible filler is compressed under load, said compressible filler gains compressive strength;*

*wherein as said yieldable container yields and decreases in length along its longitudinal axis in response to a load exerted along its longitudinal axis, said yieldable container experiences an increase in effective wall thickness per unit of length of said yieldable container;*

*wherein said yieldable container yields in response to a load exerted along its longitudinal axis by folding upon itself; and*

*wherein the mine roof support derives the ability to impede convergence between a mine roof and a mine roof from the combination of said compressible filler and said yieldable container acting in concert with each other rather than from either of said yieldable container and said compressible filler individually, and said filler increasing in load bearing capacity with increasing compression.*

*48. A mine roof support as recited in claim 47 further comprising end caps for said container with said end caps serving to prevent escape of said compressible filler from said container.*

*49. A mine roof support as recited in claim 48 wherein said end caps are made of one of metal plate and cement plate.*

*50. A mine roof support as recited in claim 47 wherein said container is at least partially constructed with straight walls.*

*51. A mine roof support for impeding convergence between a mine roof and a mine floor comprising;*

*a metal cylinder serving as a yieldable container, the yieldable container having a longitudinal axis, said yieldable container being adapted to be placed between a mine roof and a mine floor in an orientation such that the longitudinal axis of said yieldable container is generally oriented in the direction of expected convergence between a mine roof and a mine floor, said yieldable container being configured to serve as a confining structure for a filler placed within said container, and said yieldable container being yieldable under a load exerted on said yieldable container along its longitudinal axis so that over time and under sufficient load said yieldable container will yield upon itself and decrease in length in the direction of its longitudinal axis in response to said load; and*

*a compressible filler comprising cement and disposed within said container, said compressible filler being compressible under a load, and said compressible filler achieving compressibility by trapped gas existing within said filler, and said compressible filler being configured as a single unitary component located within the interior of said yieldable container and said compressible filler not pre-tensioning said yieldable container along said longitudinal axis when the container is operatively positioned;*

*wherein said container serves as a means for holding and confining said filler;*

*wherein said container has consistent yield strength along its length;*

*wherein said filler and said container are yieldable in a manner that tends to absorb and sustain load and prevent excessive pressure from being exerted on a mine floor or a mine roof, thereby avoiding punching through a mine floor or a mine roof;*

*wherein said container folds down upon itself as it yields under load;*

*wherein said filler increases in density as it is compressed;*

*wherein said container has substantial side, hoop and burst strength;*

*wherein said compressible filler and said yieldable container act in concert with each other under a load exerted along the longitudinal axis of said yieldable container in a manner such that as said compressible filler is compressed under load, said yieldable container substantially confines said compressible filler within the interior of said yieldable container in order to reduce escape of compressible filler form the interior of said yieldable container;*

*wherein said compressible filler and said yieldable container act in concert with each other under a load exerted along the longitudinal axis of said yieldable container in a manner such as said compressible filler is compressed under load, as said compressible filler is confined within said yieldable container, and as said yieldable container yields under load and decreases in length along its longitudinal axis, the effective load carrying capacity of the mine roof support increases;*

*wherein as said compressible filler is compressed under load, said compressible filler gains compressive strength;*

*wherein as said yieldable container yields and decreases in length along its longitudinal axis in response to a load exerted along its longitudinal axis, said yieldable container experiences an increase in effective wall thickness per unit of length of said yieldable container;*

*wherein said yieldable container yields in response to a load exerted along its longitudinal axis by folding upon itself; and*

*wherein the mine roof support derives the ability to impede convergence between a mine roof and a mine floor from the combination of said compressible filler and said yieldable container acting in concert with each other rather than from either of said yieldable container and said compressible filler individually, and said filler increasing in load bearing capacity with increasing compression.*

*52. A mine roof support as recited in claim 51 further comprising end caps for said container with said end caps serving to prevent escape of said compressible filler from said container.*

*53. A mine roof support as recited in claim 52 wherein said end caps are made of one of metal plate and cement plate.*

*54. A mine roof support as recited in claim 51 wherein said container is at least partially constructed with straight walls.*

* * * * *